United States Patent [19]

Estep

[11] Patent Number: 4,911,197

[45] Date of Patent: Mar. 27, 1990

[54] DRAIN STANDPIPE

[76] Inventor: William E. Estep, P.O. Box 314, Powellton, W. Va. 25161

[21] Appl. No.: 346,626

[22] Filed: May 2, 1989

[51] Int. Cl.[4] ..... D06F 39/08

[52] U.S. Cl. ..... 137/362; 137/599; 137/565; 137/593; 68/208

[58] Field of Search ..... 137/362, 565, 599, 593; 68/208

[56] References Cited

U.S. PATENT DOCUMENTS 2,049,340 7/1936 VanDerHorst et al. ..... 137/362

3,144,759 8/1964 Bochan ..... 68/208 X 3,407,633 10/1968 Giambertoni ..... 68/208 X 3,590,606 7/1971 Takeyama ..... 68/208

*Primary Examiner*—John Rivell

*Attorney, Agent, or Firm*—Richard C. Litman

[57] ABSTRACT

A washing machine standpipe that has an auxiliary drainage outlet in case the machine pump should break down. Rotation of an inner tube inside the standpipe opens a lower connection to the machine discharge hose, allowing trapped water to escape. When the lower opening is in a closed position, water exits into the standpipe from the top portion as is conventional.

8 Claims, 2 Drawing Sheets

DRAIN STANDPIPE

BACKGROUND OF THE INVENTION

1. Field of the Invention

The present invention relates to drain standpipes, more particularly it is a drain standpipe for a washing machine. Conventional washing machines have a single discharge hose extending from a pump at the bottom of the machine to the open top end of a standpipe. The open end of the standpipe is on level with the maximum water level in the machine tub to prevent overflow. Should the discharge pump break down, water will be trapped in the discharge hose. Even in a normal turned-off situation, water is left in the pipes and hoses, leading to corrosion. To empty the hose, it would have to be disengaged from the top of the standpipe and lowered below the water level so that excess water in the machine can drain out. This is a time-consuming and messy process. The present invention provides means to open a temporary opening in the standpipe below the water level, in order to allow excess water to drain out.

2. Description of the Prior Art

The following patents are felt to be related to the present invention but in no way disclose, singly or in combination, the applicant's unique invention.

| U.S. Pat. No. | Inventor |
|---|---|
| 3,091,111 | Cruse et al |
| 3,675,448 | Smith |
| 3,772,901 | Ferraro |
| 3,848,437 | Rottering |
| 4,069,837 | Jirasek |
| 4,380,243 | Braley |
| 4,418,712 | Braley |

U.S. Pat. No. 3,091,111 issued to Cruse et al. discloses a control unit for use with a standpipe and washing-machine combination which responds to an overflow condition in the drainage system associated therewith. The control unit is mounted at a particular level on the standpipe and includes a receptacle in which the electric code for the washing machine is plugged, a pressure-responsive electric switch, a tubular inlet member which extends through an aperture in the standpipe, and an electric energizing cord which is plugged into the outlet. The control unit detects abnormal rises in the water level in the standpipe and responds to such rises by turning off the electric power to the washing machine and/or sounding an audible alarm.

U.S. Pat. No. 3,675,448 issued to Smith discloses a gravity overflow tube to prevent spillage of excess water in an automatic clothes washer. The overflow tube is attached at one end to the top portion of the outer tub of the automatic washer and the other end is connected to a pump and a discharge hose which has an upper curved end received by a standpipe drain. The excess liquid flows through the overflow tube only by the force of gravity.

U.S. Pat. No. 4,069,837 issued to Jirasek discloses an overflow control unit for an automatic washing machine which interconnects the drain hose of the washer to a standpipe. The control unit is positioned within the standpipe of the drainage system and comprises a cylindrical plug device having a central axially extending passageway therethrough and a by-pass valve having an open and a closed position. The by-pass valve interconnects the passageway with the atmosphere and responds to an overflow condition in the drainage system to deactivate the washing machine.

The remainder of the above-listed patents were selected to further illustrate the state of the art.

SUMMARY OF THE INVENTION

The present invention provides for an easy-to-use mechanical auxiliary drain for a washing machine standpipe. It comprises an outer standpipe connected to a water level pipe. The water level pipe is connected at two points along the outer pipe, one lower point that serves as the auxiliary opening, and one higher point that serves as the normal-condition drainage point. The water level pipe is connected to the discharge hose at its lower end. A rotatable inner tube provides the means to drain excess trapped water through the lower opening. The rotation of the inner tube uncovers the lower opening into the drain.

A knob on the top of the assembly allows the inner pipe to be rotated in order to drain water out of the lower opening. Thus much inconvenience is saved from the person who whould otherwise have to resort to buckets to drain trapped water from the washing machine. The inner tube can also be automatically controlled.

Accordingly, it is one object of the present invention to provide a washing machine drainage system with two separate openings.

It is another object of the invention to provide a simple mechanically operated second opening for a washing machine drainage standpipe.

It is a further object of the present invention to provide an automatic drainage system for a washing machine that is convenient and easy to use.

There and other objects of the present invention will be readily apparent upon further review of the attached appended drawings, specification and claims.

DESCRIPTION OF THE PREFERRED EMBODIMENT

Figure 1:
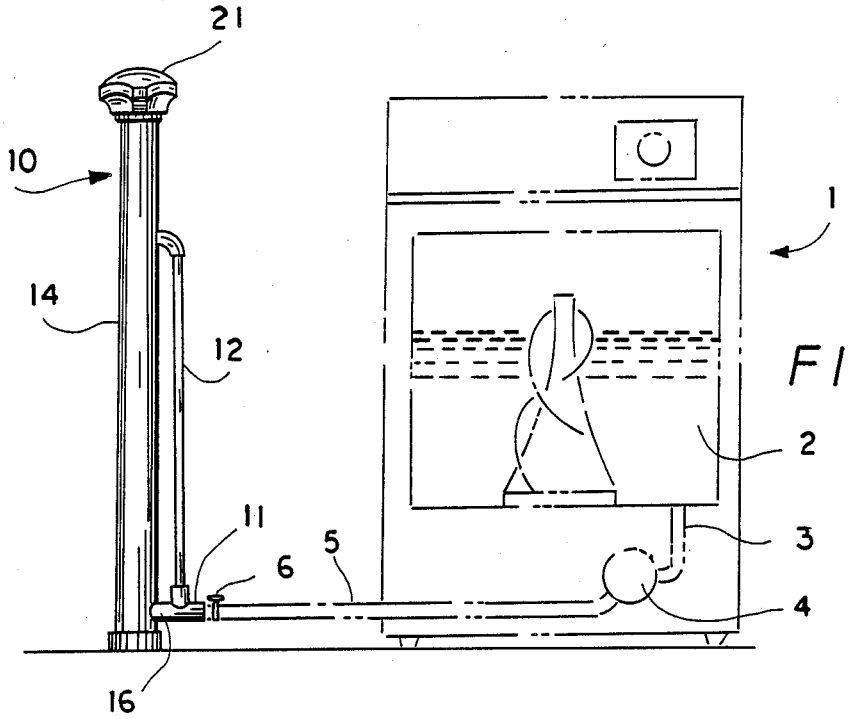
FIG. 1 shows a front view of the standpipe assembly.
Figure 2:
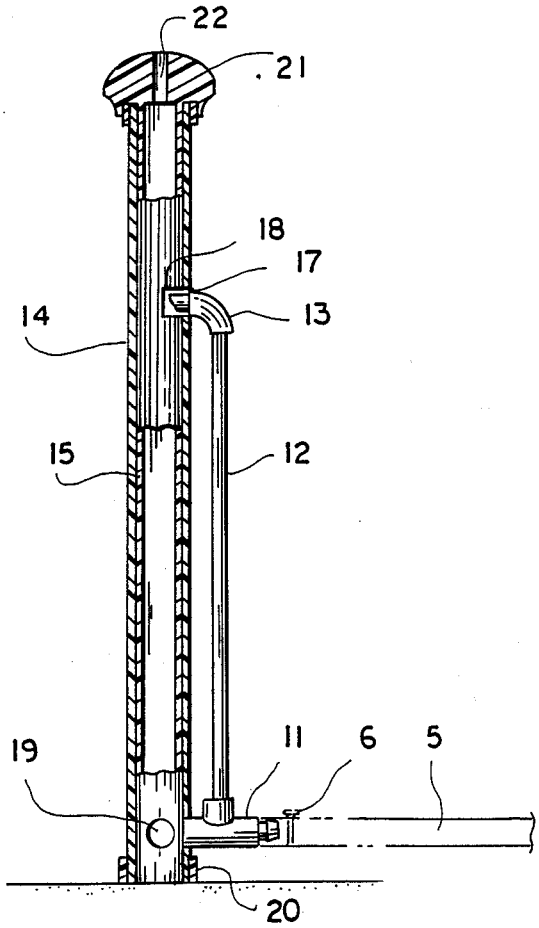
FIG. 2 shows a sectioned view of the standpipe assembly.
Figure 3:
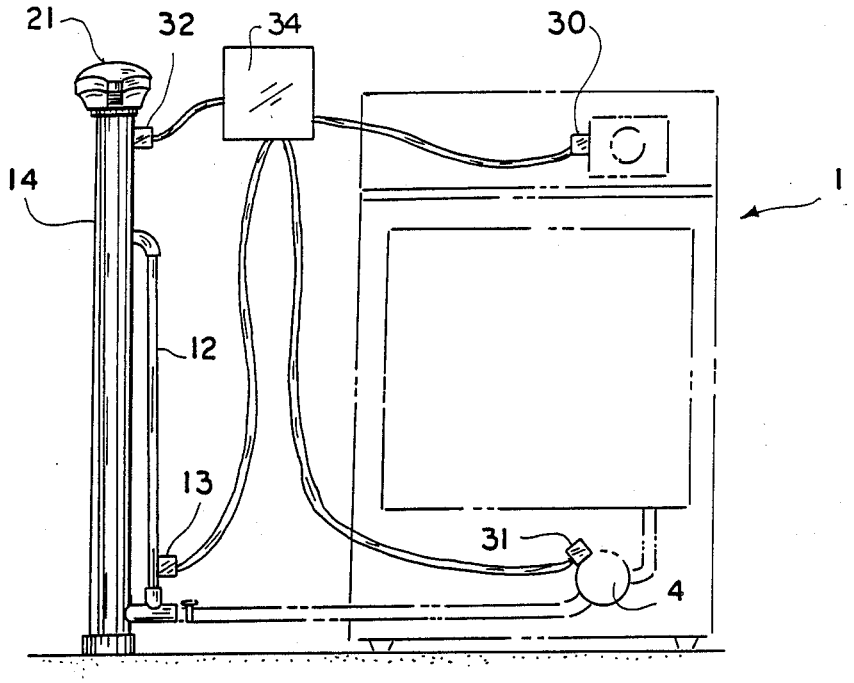
FIG. 3 shows a front view of the standpipe with the sensor system.
Figure 4:
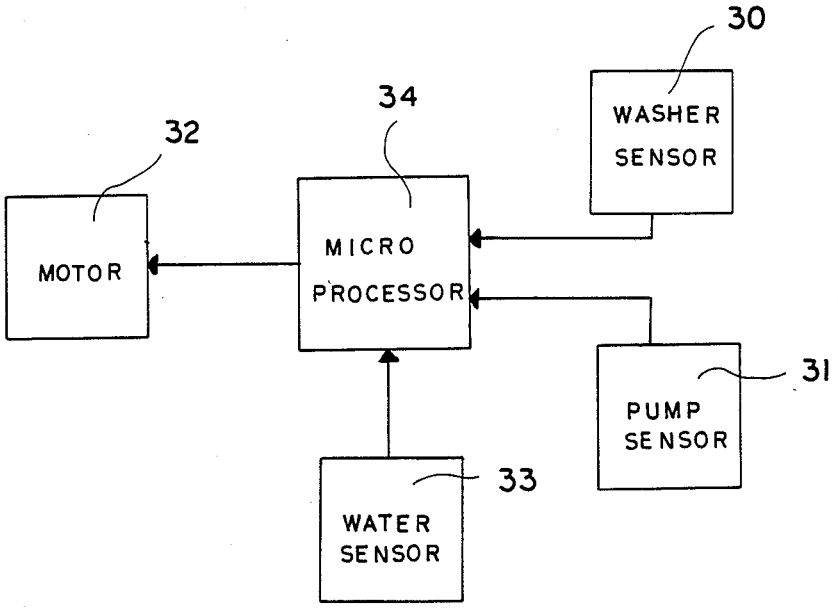
FIG. 4 shows a working diagram for the sensor system.

FIG. 1 shows the standpipe assembly 10 connected to a conventional washing machine 1, with tub 2, discharge pipe 3, pump 4 and discharge hose 5. The end of the discharge hose 5 is held onto the standpipe assembly by clamp 6. The hose attaches to the T-joint 11 of the water level pipe 12. The water level pipe 12 is attached at two distinctly separated points to an outer tube 14. A lower connection point 16 is part of the T-joint 11, and an upper connection point 17 is part of an L-joint 13 at the upper end of the water level pipe 12 which runs parallel to the outer tube 14. Upper connection 17 is at the same height as the overflow height of the washing machine 1.

Water level pipe 12 serves as the normal drainage route for a normally operating washing machine 1. Water comes through pipe 3, pump 4, and then through hose 5 and joint 11 and up water level pipe 12 to finally exit out of L-joint 13 and down into the standpipe assembly 10 to exit out through drain 20.

Inside the outer tube 14 is concentric inner tube 15. Both tubes have openings 17,18 to receive the L-joint 13 and allow normal drainage. The inner opening 18 is slotted so as to allow tube 15 rotation. Inner tube 15 is rotatable within outer tube 14. Inner tube 15 also has an additional opening 19 on level with the lower opening 16 of the outer tube 14. The secondary hole 19 on the inner tube 15 is for the auxiliary drainage means should the pump 4 break down in operation or the machine cease operation.

The two concentric tubes 14,15 are fitted closely together, but with enough clearance to allow rotation of inner tube 15 within outer tube 14..The seal between the two tubes does prevent water from seeping between them when inner tube 15 is rotated so that opening 19 is disposed away from opening 16 on the outer tube 14. Rotating inner tube 15, so that opening 19 is in line with opening 16 and T-joint 11, sets up the auxiliary drainage system when pump 4 breaks down or when it is necessary to drain the excess water that would be left in hose 5 and pipe 12 after the machine shuts down. Draining out the excess water could add life to the machine as a whole by preventing unnecessary corrosion. Outer recessed knob 21 on top of inner tube 15 allows a user to rotate the inner tube 15 to engage the auxiliary drainage system. Through the top of knob 21 is a hole 22 leading into inner pipe 15. This hole is to prevent siphoning effects by allowing the outside air pressure in. The knob 21 also has open/close markings on it to signify to the user of the condition of the inner pipe 15.

Ideally, the assembly 10 is placed behind the washing machine 1 with knob 21 sticking up a few inches over the side. This allows easy access by the user of the machine and allows the device to operate as a standard washing machine standpipe. An alternative mode of control would be to include the use of a control cable mounted between the washing machine and the the knob 21.

The standpipe assembly 10 can also include fittings for automatic control from the washing machine itself. Sensors 31 on the machine 1 and pump 4 could activate a motor 32 that would turn inner tube 15 automatically. Sensors 31 would detect shutdown of the machine or breakdown in the pump 4. Such detections would cause commands to be sent through a processor 34 to the motor 32 to operate and rotate tube 15 so as to open the lower openings 16 and 19, allowing trapped water to drain out. A water sensor 33 could also be placed in hose 5 or pipe 12 to sense the presence of water. A negative command would reclose the lower opening 16,19 by motor 32.

It is to be understood that the present invention is not limited to the sole embodiment described above, but encompasses any and all embodiments within the scope of the following claims.

I claim:

1. A drain standpipe for use with a washing machine, comprising:

a vertically standing elongated hollow outer tube having bottom and opposite ends;

a concentric elongated hollow inner tube rotatably mounted inside said outer tube, said inner tube outside surface and said outer tube inside surface forming a close seal;

two apertures on said outer tube, one of said apertures disposed adjacent a bottom end of said outer tube and the other aperture disposed toward the opposite end of said outer tube;

two apertures on said inner tube, proximal to said apertures on said outer tube, said inner tube being rotatable such that said inner and outer tube apertures are directly adjacent and form two passageways to the interior of said inner tube, fluid able to flow through said bottom end apertures when said tubes are so aligned and able to flow through said opposite end when not so aligned; and a hollow elongated water level pipe, having bottom and opposite ends, mounted exterior and parallel to said inner and outer tubes, each open end of said water level pipe mounted over one of said apertures on said outer tube such that said water level pipe can feed into the interior of said inner pipe when said inner tube is rotated.

2. The drain standpipe according to claim 1, including:

a drain affixed to the bottom end of said outer tube, allowing fluid to run off from the interior of said tubes.

3. The drain standpipe according to claim 1, including;

a T-joint on said water level pipe bottom end, one end of said joint mounted over said outer tube aperture and the other end mounted to a washing machine discharge hose; and an L-joint on said water level pipe opposite end, said L-joint mounted over said outer tube aperture.

4. The drain standpipe according to claim 3, wherein;

said inner tube opposite end aperture comprises an elongated slot, said L-joint end extends into said inner tube interior through said aperture, said elongated slot allowing the inner tube to be rotated.

5. The drain standpipe according to claim 1, including;

a knob affixed to the opposite end of said inner tube, allowing a user to rotate said inner tube, said knob being recessed over the edge of said outer tube opposite end.

6. The drain standpipe according to claim 1, including;

motor means mounted on said inner tube opposite end, said motor means capable of rotating said inner tube in response to commands from a processor means and sensor means mounted on said washing machine.

7. The drain standpipe according to claim 6, wherein;

said motor means rotates said inner tube to allow fluid to feed through said bottom end apertures when said washing machine stops running.

8. The drain standpipe according to claim 6, wherein;

said motor means rotates said inner tube to close off said bottom apertures when said washing machine is operating.

* * * * *